United States Patent [19]

Thompson

[11] Patent Number: 4,969,618

[45] Date of Patent: Nov. 13, 1990

[54] CONTAINER HOLDER

[76] Inventor: Steve Thompson, 202 N. Otter St., Mercer, Pa. 16173

[21] Appl. No.: 236,159

[22] Filed: Aug. 25, 1988

[51] Int. Cl.[5] ..... A47G 35/00

[52] U.S. Cl. ..... 248/152; 248/313; 248/346.1

[58] Field of Search ..... 248/152, 311.2, 313, 248/314, 359.1, 604, 523, 310, 346.1; 211/89

[56] References Cited

U.S. PATENT DOCUMENTS

| | | | |
|---|---|---|---|
| 1,171,210 | 2/1916 | Keffer | 248/152 |
| 2,381,939 | 8/1945 | Nelson . | |
| 2,710,694 | 6/1955 | Carr | 211/89 X |
| 2,774,481 | 12/1956 | Sievers et al. | 211/89 |
| 2,803,418 | 8/1957 | Smith . | |
| 2,956,687 | 10/1960 | Robichaud | 248/314 X |
| 2,962,156 | 11/1960 | Adams | 211/89 X |
| 2,963,256 | 12/1960 | Burah | 248/346.1 |
| 3,013,758 | 12/1961 | Smith . | |
| 3,241,524 | 3/1966 | Torson | 248/523 X |
| 3,357,669 | 12/1967 | D'Amato | 248/152 X |
| 3,582,028 | 6/1971 | Purdy | 248/523 X |
| 3,918,920 | 11/1975 | Barber | 248/314 X |
| 4,005,942 | 2/1977 | Gilb | 248/903 X |
| 4,025,012 | 5/1977 | Chan et al. . | |
| 4,597,550 | 7/1986 | Rice, Sr. . | |
| 4,638,595 | 1/1987 | Rivero . | |

FOREIGN PATENT DOCUMENTS

| | | | |
|---|---|---|---|
| 2451732 | 11/1980 | France | 248/152 |
| 10783 | of 1908 | United Kingdom | 248/346.1 |
| 296151 | 8/1928 | United Kingdom | 248/152 |

*Primary Examiner*—David L. Talbott
*Attorney, Agent, or Firm*—Thomas R. Shaffer

[57] ABSTRACT

A container holder is disclosed which includes a base member and plural foam members. The base member has a central hub portion from which a plurality of spaced apart leg portions extend generally outwardly each in a different directions. A plurality of upright portions also extend from the hub but in a generally upwardly direction from locations between adjacent leg portions. A foam member is attached to an inward face of each of the upright poritons in a manner such that outer ends of said leg portions are positioned to rest aganist a generally flat surface, such as the floor of a van or truck, to provide a stable support and the foam members are positioned and spaced to receive and support a wide range of container sizes and shapes.

12 Claims, 3 Drawing Sheets

CONTAINER HOLDER

BACKGROUND OF THE INVENTION

1. Field of the Invention

The present invention relates to an apparatus for holding containers during transportation. More specifically, it relates to an portable apparatus for holding a variety of differently shaped and sized pots and vases utilized for plants and flowers especially during transportation thereof.

2. Description of the Prior Art

The problems associated with the transportation of plants and flowers are well known to florist shop owners and employees and others who must frequently transport such cargo. One goal in this field is to minimize the time required to load and unload containers of plants or flowers from a delivery van or truck. However, because of the fragile and delicate nature of the cargo, care must be taken to adequately support and protect the expensive plants and flowers during transportation. Another goal is to provide a holder which is lightweight, portable, inexpensive, and which allows for a maximum utilization of floor space in the truck or van. A variety of different types of devices have been proposed for the holding and transporting of plant and flower pots and vases but, to date, there has been no acceptable solution to the problems. U.S. Pat. No. 4,638,595, for example, discloses a wheeled device for transporting plants in their pots. It has upright members for supporting the plant pot on the base which hold the plant by the tension of the upright members against the pot. The provision of wheels makes this device unsuitable for use in securing pots in a stationary position during transportation.

U.S. Pat. 3,013,758 discloses a wire basket on widely spread wire legs. The wire basket is firmly affixed to the legs and has an upper hoop forming the opening into which the plant is placed. Only a specific sized pot can fit into the pre-formed ring. Use of the device with a pot too small will allow movement within the device. A pot too large would have a center of gravity too high above the ring, and could easily spill or break.

U.S. Pat. No. 2,803,418 discloses a device which utilizes a number of specially designed hooks which attach to the upper lip of the flowerpot and are connected to each other and to a base by bendable wire. The use of separate hooks allows the use of the invention on a number of different sized pots. However, the requirement that the wire be permanently affixed to a base destroys portability. Although the device accommodates a variety of pot shapes and sizes, each pot must be custom-installed. Such a device would not be useful in delivery and truck transport of plants, since it would be extremely time consuming to wire up all of the plants for delivery each time the van or truck was loaded.

U.S. Pat. No. 4,597,550 discloses a molded plastic base for supporting a flower pot. It is specifically designed for displaying the flowers at an angle and provides little or no support for transportation. Further, like U.S. Pat. No. 3,013,758, it is adapted for a specific size of pot.

U.S. Pat. No. 2,381,939 discloses a flower pot constructed of wood members or staves held together by a wire or metal hoop. Like many other devices which have been proposed, it is adapted primarily for one size pot.

U.S. Pat. No. 4,025,012 discloses a decorative holder not specifically designed for plants. In one embodiment, it has a base on legs formed from decoratively bent metal. The base as shown is not designed to support the object against any movement, but merely to provide a decorative stand or base.

There remains, therefore, a need for a portable, inexpensive device which can hold a variety of differently shaped pot and vases during transportation.

There further remains a need for such a device which protects delicate plants and flowers from vibration during transport form location to location in a truck or van.

Still further, there remains a need for such a device which provides lateral support against tipping in a manner which allows for utilization of substantially the entire floor area of a truck or van.

SUMMARY OF THE INVENTION

The present invention provides a solution to these needs by providing an apparatus for holding containers which includes a base member and plural attached foam pad members. The base has a central hub portion from which a plurality of spaced apart leg portions extend generally outwardly each in a different directions and from which hub a plurality of upright portions extend generally upwardly from locations between adjacent leg portions. The foam members are attached to an inward face of each of said upright portions whereby outer ends of said leg portions are positioned to rest against a generally flat surface, such as the floor of a truck or van, to provide a stable support and said foam members are positioned and spaced to receive and support a wide range of container sizes and shapes.

Preferably the base member is fabricated from a single piece of galvanized steel and each leg portion has an upwardly extending stiffening rib provided along the entire length thereof. Further, the upright portions preferably have a generally shallow U-shape cross-sectional configuration with an open side facing inwardly toward the hub into which the foam members are placed.

The upright portions of the base member preferably extend upwardly to an angle slightly less than vertical. An angle of approximately 15° from a vertical orientation has been found to be particularly effective for allowing insertion of a wide variety of pots and vases. Further, the leg portions preferably extend downwardly at an angle of approximately 5 ° from said hub.

Each foam member is preferably glued to a generally flat backing sheet which sheet is removably attached to upright portions by screws or the like. Further, at least the inward facing surfaces of each foam member is preferably covered with a wear resistent fabric such as nylon. This can be most easily accomplished by providing a sleeve of nylon which extends around the foam member covering the inward, outward, upper and lower surfaces and leaving opposite side portions thereof uncovered. Each foam member also preferably has a top end which is tapered to allow for easy insertion of a container from above.

The foam members of the invention not only allow for insertion and support of a wide variety of containers but also provide damping of vibration during transportation.

An additional advantage of the present invention is that the use of spaced apart leg portions on the base member allows for leg portions of an adjacent container holder to be positioned between the leg members of the first holder. In this way, plural holders of the present invention may be laterally nested during use with leg portions of adjacent containers positioned between leg portions of neighboring containers. Still further, the design of the present invention allows for vertical nesting of a plurality of holders when not in use to provide for compact storage.

These and other advantages and features of the present invention will be more fully understood on reference to the following description of the presently preferred embodiments thereof and to the appended drawings.

DESCRIPTION OF THE PREFERRED EMBODIMENTS

Figure 8:
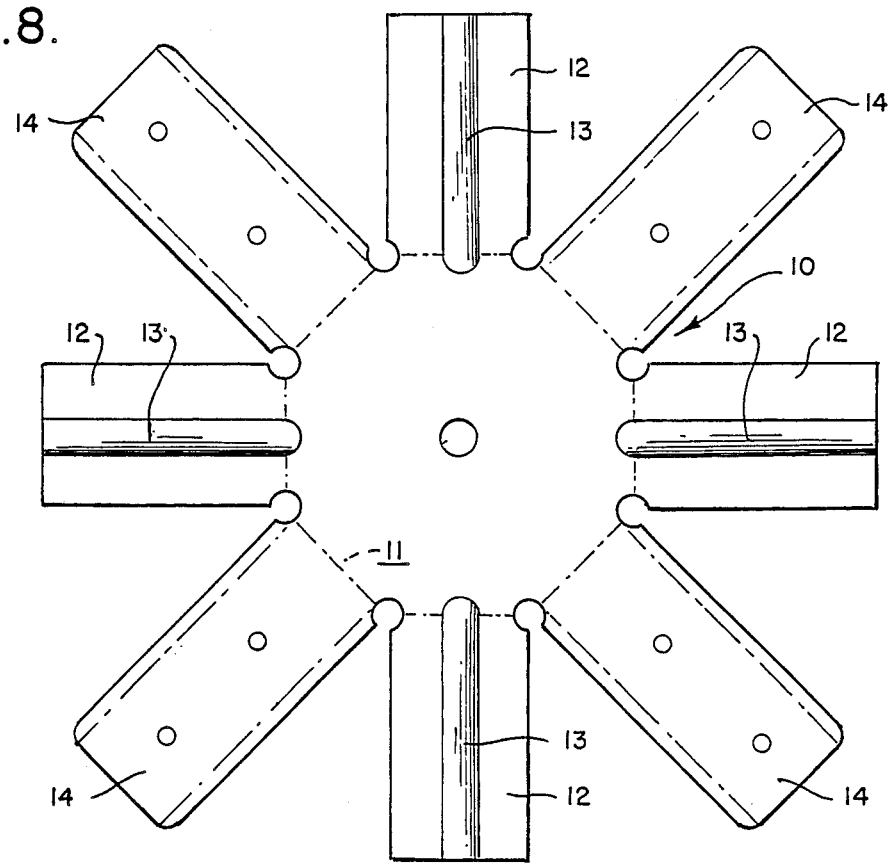
FIG. 8 is a top plan view of a base member in cutout form prior to bending of the leg members and upright members.
Figure 4:
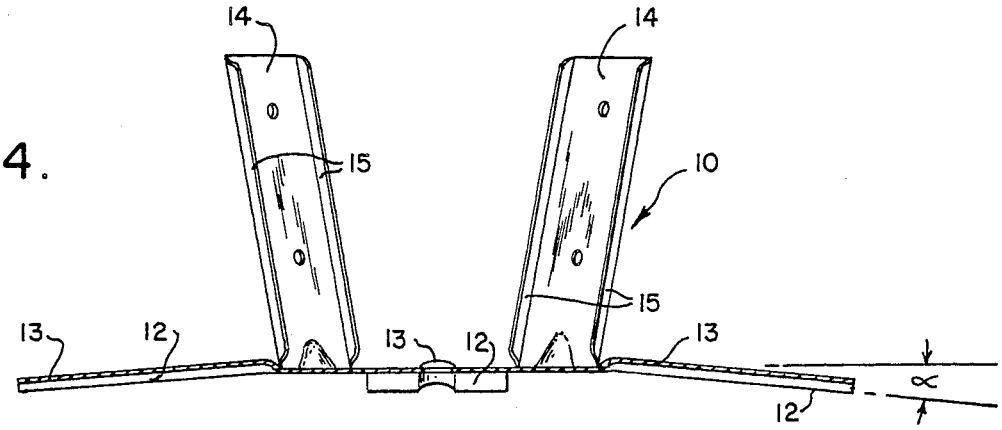
FIG. 4 is a cross sectional view taken on the line IV—IV of FIG. 2.

Referring to the Figures, base member 10 is formed from a generally flat single sheet of galvanized steel cut to the shape shown in FIG. 8. It is contemplated, however, that a suitable plastic material or other type of metal could be used. Base member 10 has a plurality of leg members 12 extending outward from a central hub portion 11 (shown in dotted line in FIG. 8). These members are formed downwardly at an angle $\alpha$ of approximately 5° with respect to the hub 11. This downward extension causes the outermost ends of the leg portions 12 to support the base member. Leg members 12 are provided with stiffening ribs 13 to add strength and rigidity to the base.

Base 10 also has plural upwardly extending portions 14 which are formed to extend upwardly to an angle $\beta$ which is preferably 15° with respect to a vertical position. Upwardly extending portions 14 have a cross-sectional configuration in the form of a shallow "U". This shape allows side portions 15 of upright portions 14 to receive foam member 20 and adds additional strength to the base member. In the Figures, a container holder have four leg portions and four upwardly extending portions is shown. It is to be understood that while this arrangement represents the presently preferred embodiment of the invention, that a similar holder having any number of leg and upright portions greater than two each is considered to be functional and within the scope of the present invention.

Figure 3:
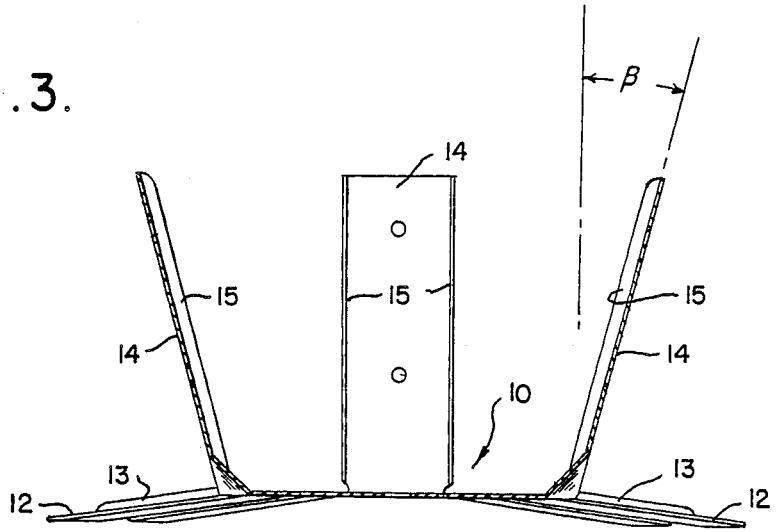
FIG. 3 is a cross sectional view of the base taken on the line III—III of FIG. 2.
Figure 1:
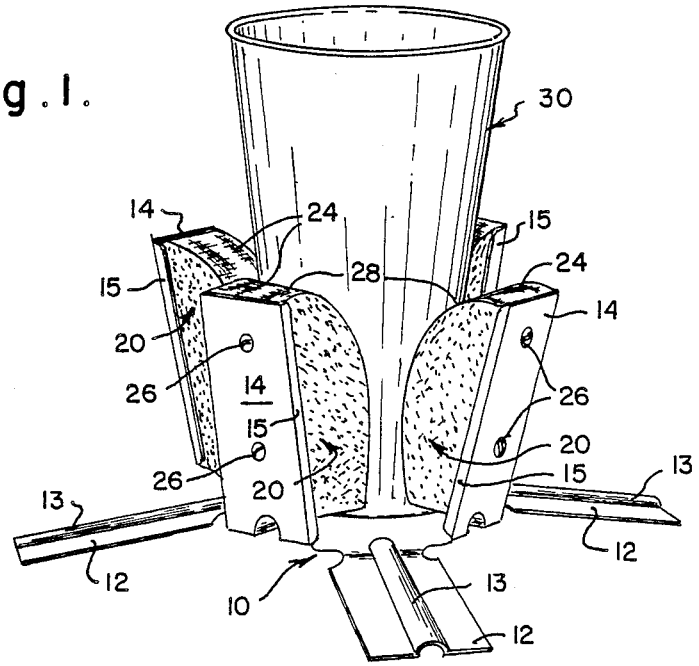
FIG. 1 is an isometric view of the preferred embodiment of the container holder of present invention shown holding a container.
Figure 2:
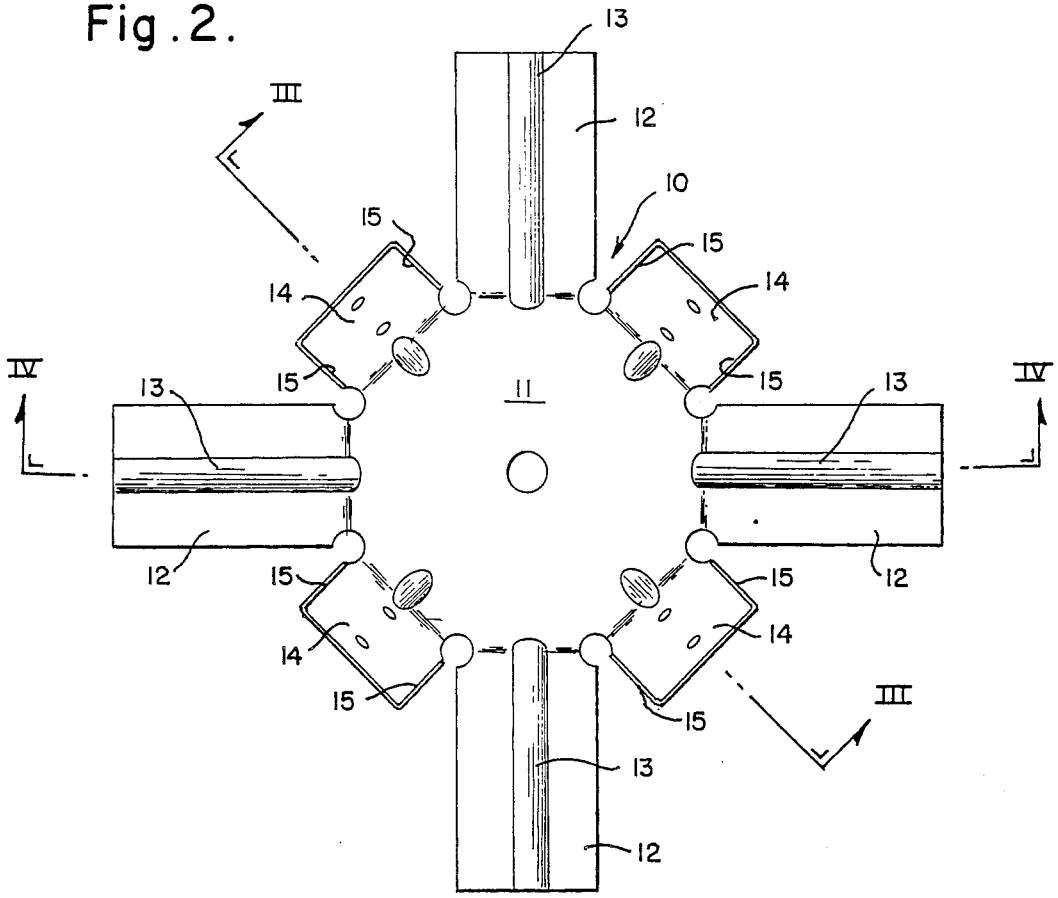
FIG. 2 is an a top plan view of the base member of the container holder of FIG. 1 prior to the attachment of foam members.
Figure 6:
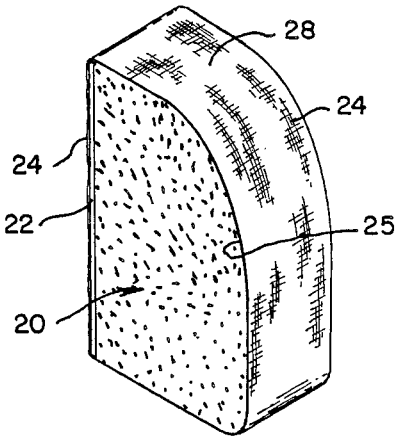
FIGS. 6 and 7 are isometric views showing the inward and outward faces, respectively, of a foam member, backing plate and sleeve members as assembled prior to attachment to the base.
Figure 7:
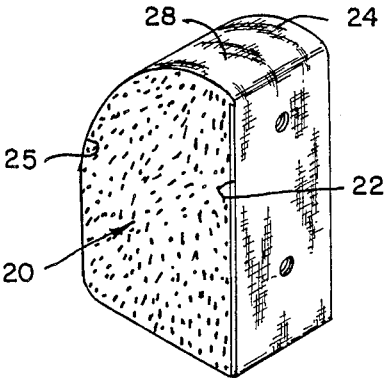
Figure 5:
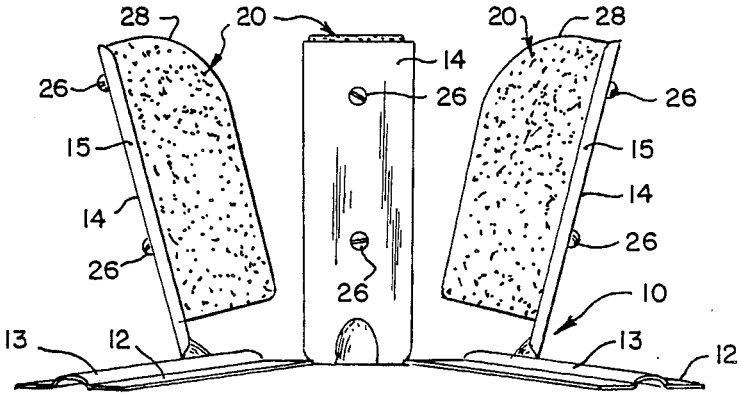
FIG. 5 is a side elevational view of the container holder of FIG. 1.

Foam members 20, as best shown in FIGS. 6 and 7 are formed from any suitable foam product such as polyurethane foam. The foam material preferably has a relatively fast recovery time from compression (less than 10 seconds) to allow for immediate successive uses for different sized containers. Upper end portions 28 of the foam members are curved or tapered to allow for easy insertion of variously shaped and sized containers from a location above the holder. As best shown in FIGS. 1 and 5, each foam member 20 is attached to an inward face of each of said upright portions 14 at a location such that a lowermost end of each foam member 14 is spaced above hub 11 creating a gap between each foam member 14 and said hub 11. Foam members are glued to a backing plate 22 (FIGS. 6 and 7) which is removably attached to upright members 14 by suitable fasteners such as screws 26. This feature allows for easy repair of replacement of the foam members. A nylon fabric sleeve 24 is provided over the foam members 20 around the perimeter 25 thereof as shown in FIGS. 6 and 7 to protect and extend the lifetime of such members. Alternatively, the entire foam member may be covered.

In operation a vase, such as vase 30 as shown in FIG. 1, is inserted between the inward faces of the nylon covered foam members. The foam members are compressed during insertion and provide and outward force on the container holding it firmly in place. Additionally, because the thickness of the foam members and because the upright members may be deflected slightly outwardly, the holder of the present invention may hold a wide variety of container shapes and sizes. Finally, because of the use of the foam members, vibration to the containers and the contents thereof is greatly reduced during transportation of the containers in a truck or van.

While I have described a present preferred embodiment of the invention, it is to be distinctly understood that the invention is not limited thereto but may be otherwise embodied and practiced within the scope of the following claims.

I claim:

1. A container holder comprising:

(a) a base member having a central hub portion from which a plurality of spaced apart leg portions extend generally outwardly each in a different direction and from which hub a plurality of upright portions extend generally upwardly from locations between adjacent leg portions at an angle more then 90° from said hub, said upright portions having a length approximately equal to or greater than the length of said leg portions; and (b) an elongate foam member formed of a compressible foam material having a relatively fast recovery time from compression, said elongate foam member having one side portion attached along the entire length of the foam member to an inward face of each of said upright portions, said foam members positioned and spaced to receive and support a container, whereby outer ends of said leg portions are positioned to rest against a generally flat surface to provide a stable support for the base, whereby said foam members are compressed during insertion of said container and provide an inward force on the container holding said container in place, whereby said upright members may be deflected slightly outwardly and whereby use of said compressible foam members and deflectable upright members allows for the insertion and support of a variety of container sizes and shapes.

2. A container holder according to claim 1 wherein said base member is fabricated from a single piece of galvanized steel.

3. A container holder according to claim 1 wherein each leg portion has a stiffening rib provided along the entire length thereof.

4. A container holder according to claim 1 wherein said upright portions have a generally shallow U-shape cross-sectional configuration with an open side facing inwardly toward the hub.

5. A container holder according to claim 1 wherein each said foam member is glued to a rigid, generally flat backing sheet, which sheet and attached foam member is removably attached to upright portions by screws or the like.

6. A container holder according to claim 1 wherein each foam member is at least partially covered with a protective fabric material.

7. A container holder according to claim 6 wherein said material is nylon and is in the form of a sleeve.

8. A container holder according to claim 1 wherein each foam member has a top end which is tapered to allow for easy insertion of a container from above.

9. A container holder according to claim 1 wherein each said foam member has a lowermost end spaced above said hub creating a gap between each foam member and said hub.

10. A container holder according to claim 1 wherein said upright members extend upwardly of an angle of approximately 15° from a vertical position.

11. A container holder according to claim 1 wherein said leg members extend outward from and downwardly at an angle of approximately 5° from said hub.

12. A container holder according to claim 11 wherein said foam members damp vibration transmitted to a container supported therein during transportation.

* * * * *